US006376016B1

(12) United States Patent
Farquhar et al.

(10) Patent No.: US 6,376,016 B1
(45) Date of Patent: Apr. 23, 2002

(54) METHOD FOR PAINTING A VEHICLE WITH AT LEAST TWO COLORS

(75) Inventors: Gary Farquhar, Farmington Hills; Malgorzata M. Skender, Birmingham; Michael R. Wilson, Novi, all of MI (US)

(73) Assignee: Ford Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/594,138

(22) Filed: Jun. 14, 2000

(51) Int. Cl.[7] ..... B05D 1/02

(52) U.S. Cl. ..... 427/258; 427/261; 427/265; 427/287; 427/424

(58) Field of Search ..... 427/258, 261, 427/265, 287, 424; 118/313, 314

(56) References Cited

U.S. PATENT DOCUMENTS 4,527,507 A * 7/1985 Sawai et al. ..... 118/314
4,740,384 A * 4/1988 Meisner et al. ..... 427/261
5,429,682 A * 7/1995 Harlow Jr. et al. ..... 118/681
5,794,859 A 8/1998 Goenka et al.

FOREIGN PATENT DOCUMENTS

| | | | |
|---|---|---|---|
| EP | 8 22 011 A2 | | 2/1998 |
| JP | 8-155386 | * | 6/1996 |
| JP | 11-57606 | * | 3/1999 |

* cited by examiner

*Primary Examiner*—Katherine A. Bareford
(74) *Attorney, Agent, or Firm*—Ford Global Technologies, Inc.

(57) ABSTRACT

A method for painting a vehicle is disclosed. The method includes applying a first base coat to a first portion of the body of the vehicle and applying a second base coat to a second portion of the vehicle while the first base coat remains unmasked, effective to cooperate with the first base coat to form a line of demarcation.

13 Claims, 4 Drawing Sheets

METHOD FOR PAINTING A VEHICLE WITH AT LEAST TWO COLORS

(1) FIELD OF INVENTION

The present invention relates to a method for painting a vehicle with at least two colors, hues and/or shades of paint. More specifically, the present invention relates to a method for painting a vehicle with at least two colors, hues and/or shades of paint without having to mask or cover a portion of the vehicle.

(2) BACKGROUND OF THE INVENTION

It is often desirable to paint a vehicle body with two or more colors, hues and/or shades of paint on two or more different portions of the vehicle body. Vehicles painted in this manner are conventionally referred to as "two-tone" vehicles and the process by which they are painted is commonly referred to as a "two-tone" painting process.

According to a conventional method, a two-tone painting process is performed by applying a first base coat to a first portion of the body of the vehicle as the vehicle moves through a conventional paint booth, and then applying a clear coat of paint to the body of the vehicle as the vehicle moves further through the paint booth. The first base coat and the clear coat are then baked in a conventional manner. Thereafter the first base coat is covered with a conventional masking material (e.g., a masking sheet), and a second base coat is applied to a second portion of the vehicle body by moving or transporting the vehicle through a paint booth. Finally, a second clear coat of paint is applied to the body of the vehicle, and the second base coat and the second clear coat are baked within a conventional oven.

This conventional "two-tone" painting process or method suffers from some drawbacks. In particular, the conventional method requires a relatively large number of steps which include transporting the vehicle through a paint booth at least twice, applying at least two layers of clear coat paint, baking both the first and second base coat twice, and applying a masking material to the vehicle after it has received the first base coat of paint and before it has received the second base coat of paint. The relatively large number of required operations delays the production of vehicles and increases the cost and the inefficiency of the overall vehicle production process.

It is therefore desirable to provide a method for applying two or more colors, hues and/or shades of paint to a vehicle body which lowers and/or reduces the number of operations currently used to apply such paint to the vehicle body.

SUMMARY OF THE INVENTION

It is a first object of the present invention to provide a method for painting a vehicle which overcomes the previously delineated drawbacks of conventional methods for painting a vehicle.

It is a second object of the present invention to provide a method for painting a vehicle in which two colors, hues and/or shades of paint may be applied to the vehicle body in an efficient manner.

According to a first aspect of the present invention a method is provided for applying a first and second paint material to an object. The method includes the steps of applying the first paint material to an entire first portion of the object and partially applying the paint material to a second portion of the object; and applying the second paint material to the entire second portion, thereby covering the partially applied first paint material and causing the applied second paint material to cooperate with the applied first paint material to form a line of demarcation.

These and other objects, aspects, and advantages of the present invention will become apparent upon reading the following detailed description in combination with the accompanying drawings.

DETAILED DESCRIPTION OF THE PREFERRED EMBODIMENT OF THE INVENTION

Figure 1:
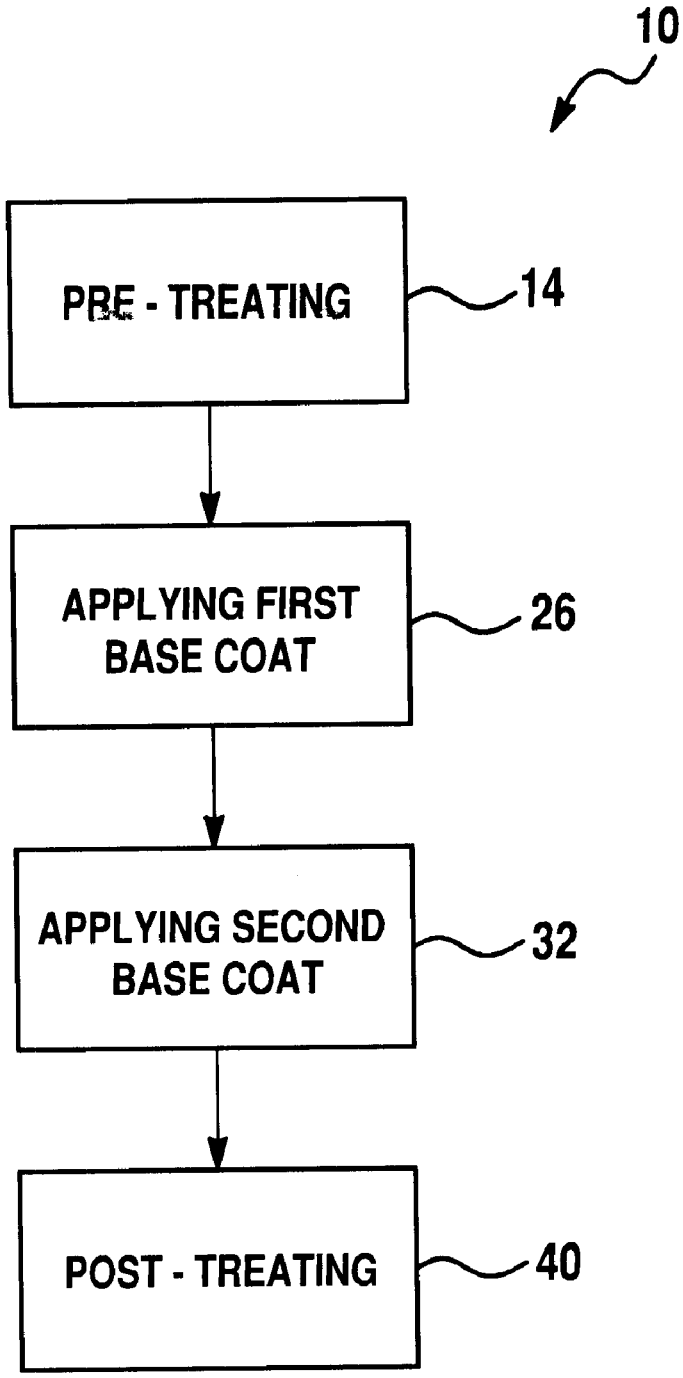
FIG 1. comprises a flowchart including a sequence of operations, which cooperatively comprise a method for painting a vehicle according to a preferred embodiment of the present invention.
Figure 2:
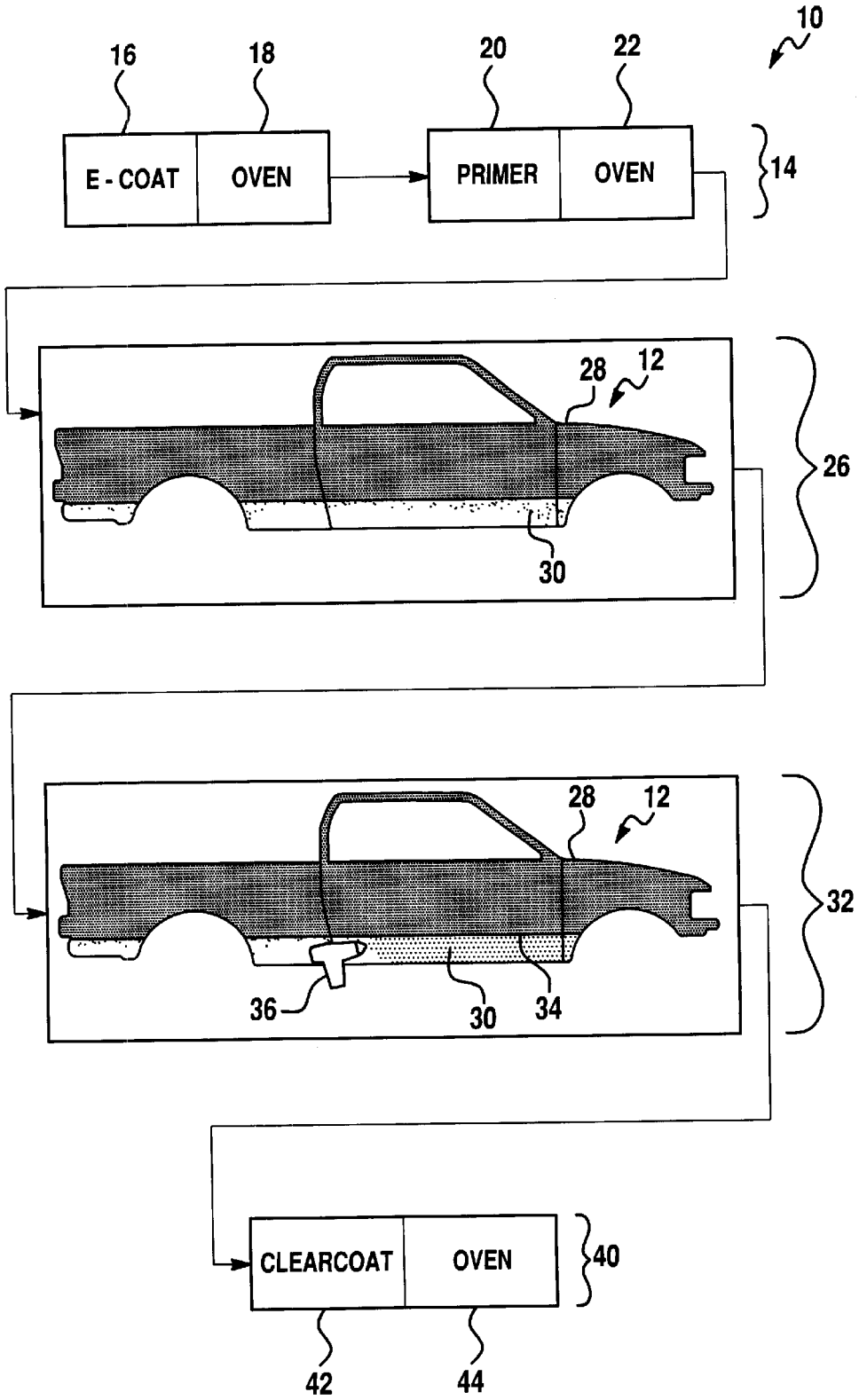
FIG. 2 comprises a schematic diagram of the method shown in FIG. 1.

Referring now to FIGS. 1 and 2, there is shown a flowchart and/or method 10 for painting a vehicle 12 which is performed according to a preferred embodiment of the present invention.

The first step 14 of the method 10 includes and/or requires "pre-treating" the vehicle. In a non-limiting embodiment of the invention, the vehicle 12 is pre-treated in a known and conventional manner. For example, and without limitation, such required pre-treating of the vehicle 12 includes applying a conventional enamel coating type material (e.g., an "E-coat") 16 to vehicle 12, baking the enamel coat 16 onto vehicle 12 in a conventional oven 18, applying a conventional coat of primer 20 to the previously deposited enamel coating 16, and baking the coat of primer 20 in a conventional oven 22, thereby allowing and/or causing the primer 20 to adhere to the previously deposited coat 16.

The second step 26 of the method 10 includes applying a first base coat to a first portion 28 of the vehicle 12 while allowing a portion of the first base coat to be applied to a second portion 30 of the vehicle 12 which is adjacent to and/or contiguous to the first portion 28. In a non-limiting embodiment of the invention, the first base coat is applied in a conventional manner using conventional spray nozzles as the vehicle 12 is moved and/or transported through a conventional paint booth. In this non-limiting embodiment, the conventional spray nozzle coats the entire first portion 28 of the vehicle 12 with a conventional base coat. However, the conventional spray nozzle also applies a relatively small amount of paint to the second portion 30 of the vehicle 12 which is adjacent to the first portion 28 as the conventional spray nozzle fully coats the first portion 28 of the vehicle 12, due to the relatively "broad" or imprecise spray pattern of the conventional spray nozzles. Hence, the paint which is applied to the second portion 30 is unintentionally and/or incidentally applied to this second portion 30 and only partially "covers" or resides within this second portion 30.

The third step 32 of the method 10 includes applying a second base coat to the second portion 30 of the vehicle 12 while the first base coat and first portion 28 remain "exposed" or remain in an "unmasked" or "uncovered"

condition. In one non-limiting embodiment of the invention, the second base coat is applied with an applicator which is capable of substantially forming a straight and precise line of demarcation 34 where the first portion 28 of the vehicle meets and abuts the second portion 30. In one non-limiting embodiment, the second base coat is applied with a precision type nozzle 36. In one non-limiting example, the first base coat is of a first color, hue and/or shade of paint, and the second base coat is of a second or different color, hue and/or shade of paint and is applied with a micro machined matrix array spray nozzle such as the one disclosed within U.S. Pat. No. 5,794,859 to Goenka, et al., which is fully and completely incorporated herein by reference. In this non-limiting embodiment, the spray nozzle is controlled by a robotic device which causes the nozzle to travel relatively close to the vehicle. Furthermore, the robotic device and/or the nozzle includes a conventional guide member (not shown) which contacts the vehicle 12 as the nozzle applies the second coat in order to maintain the nozzle at a predetermined distance from the body of the vehicle as paint is emitted from the nozzle. In this manner, line 34 is formed as a clear delineation or demarcation between the two colors, hues and/or shades of the first and second base coats. If the array spray nozzle is not effective to coat the entire second portion 30, any remainder or uncoated area is coated in a conventional manner with paint of the same color, hue and/or shade as the second base coat.

It shall be recognized that applying the first and second base coats according to the second and the third steps 26, 32 of method 10, allows the second base coat to be applied to the second portion 30 of the vehicle 12 immediately or substantially immediately (e.g., less than ten seconds) after the first base coat has been applied. In some instances, the first coat may be still partially wet. It shall also be recognized that applying paint according to method 10 allows the first coat and second coat of paint to be applied in the same paint booth, alternatively, the first and second base coats may be respectively applied upon vehicle 12 in consecutive paint booths. In either paint booth arrangement, the first coat and second coat may be applied without the use of any "intervening" operational steps in the painting process, such as waiting for the base coat to dry and then masking the first portion 28 before applying the second base coat.

The fourth step 40 of the method 10 includes posttreating the first and the second portions 28, 30. In one non-limiting embodiment of the invention, such posttreating step 40 includes applying a conventional clear coat paint 42 or material to the vehicle 12 (i.e. to the previously deposited base coats) in a conventional paint booth and baking the first base coat, the second base coat and the clear coat in a conventional manner, such as within a conventional oven 44.

Figure 3:
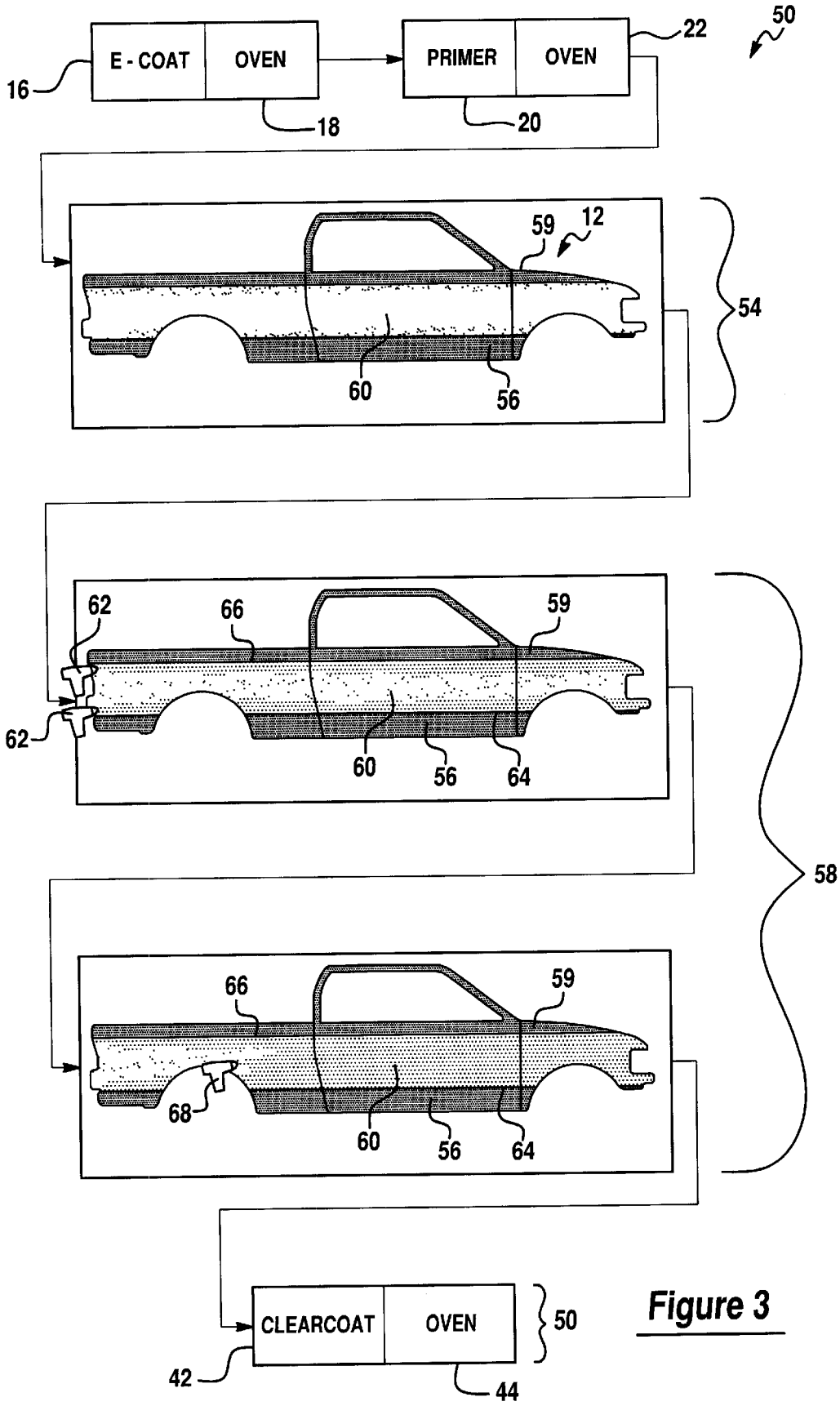
FIG. 3 comprises a schematic diagram of a method for painting a vehicle according to an alternative embodiment of the present invention.

Referring now to FIG. 3 there is shown a schematic diagram 50 which illustrates a second painting methodology, which is performed according to an alternative embodiment of the present invention. The second method shown in FIG. 3, is substantially identical to the previously delineated method 10 with the exception that the second step 26 of applying a first base coat to vehicle 12 and the third step 30 of applying a second base coat to vehicle 12 have been respectively replaced with second step 54 and third step 58. The second step 54 includes applying a first base coat to a first and second portions 56, 59 of the vehicle 12 while allowing a portion of the first base coat to be applied to a third portion 60 of the vehicle 12 which resides between the first portion 56 and the second portion 59. The third step 58 includes applying a second base coat to the third portion 60 of the vehicle 12 while the first base coat remains exposed or "unmasked". The first base coat is applied to the first portion 56 and the second portion 59 in a conventional manner using conventional spray nozzles as vehicle 12 is moved and/or transported through a conventional paint booth. Again, a small amount of paint used to form the first base coat will be applied to the third portion 60 of the vehicle 12 just as a small amount of paint used to for the first base coat in method 10 is applied to the second portion 30 of the vehicle 12.

In a non-limiting embodiment of the third step 58, the second base coat is partially applied with one or more applicators 62 which are capable of substantially and selectively forming a line of demarcation 64 where the first portion 56 of the vehicle meets and/or abuts the third portion 60, and forming a line of demarcation 66 where the second portion 59 of the vehicle 12 meets and/or abuts the third portion 60. In one non-limiting embodiment, the second base coat is at least partially applied with a precision nozzle 62. In a non-limiting embodiment, the first base coat is a different color, hue and/or shade than the second base coat and the second base coat is at least partially applied with micro machined matrix array spray nozzles as used in method 10. Alternatively, the second coat is applied with first and second matrix array spray nozzles 62 which respectively form lines 64, 66 and the second coat is further applied with a conventional applicator 68 which "fills in" or coats any exposed or uncoated portion of the third portion 60 of the body of the vehicle 12 which was not coated by the first and second matrix spray nozzles 62. It shall be recognized that the first and second base coats of this previously delineated method may be applied in a single paint booth, thereby requiring vehicle 12 to only pass once through this single paint booth.

Figure 4:
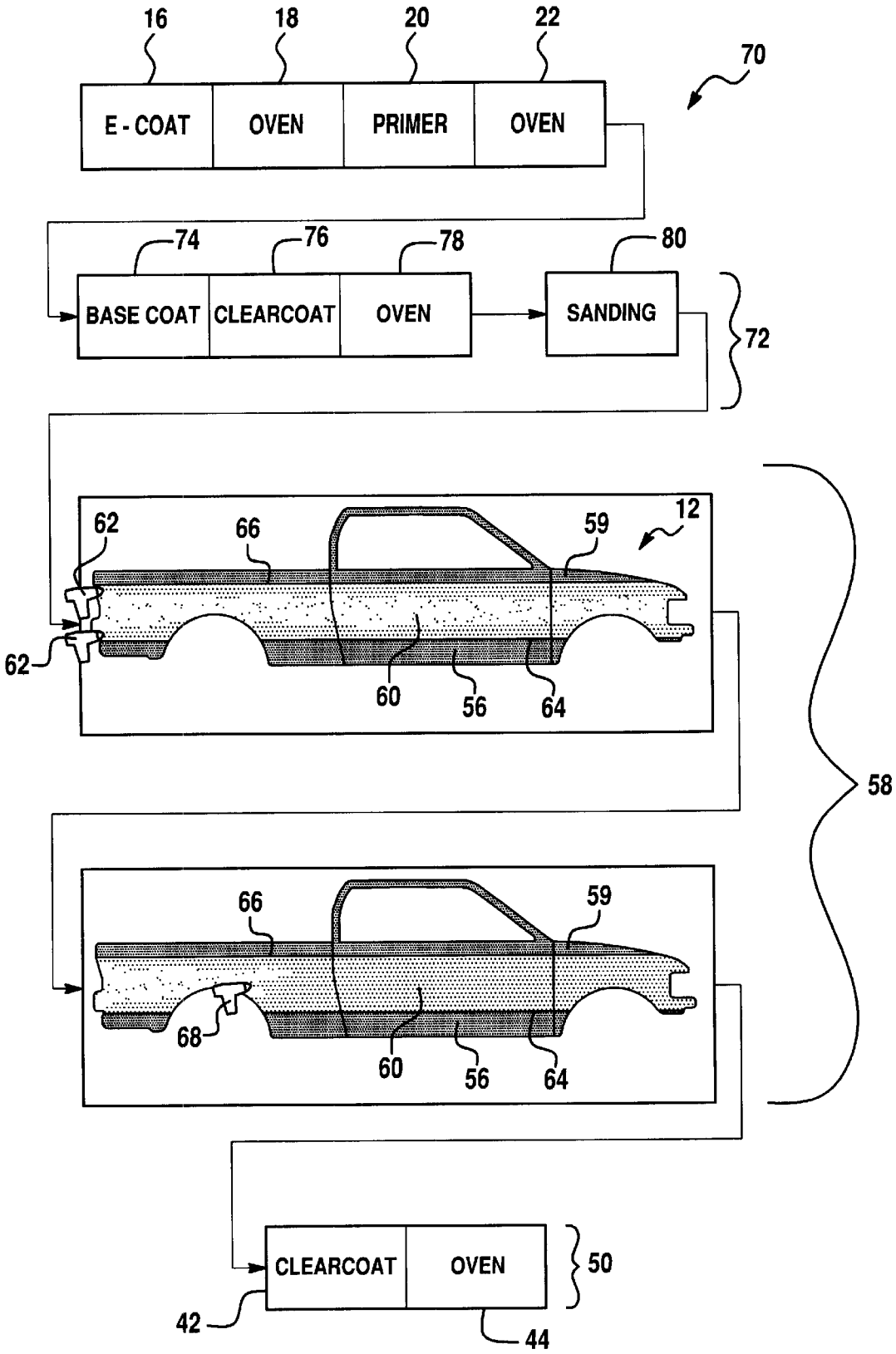
FIG. 4 comprises a schematic diagram of a method for painting a vehicle according to another alternative embodiment of the present invention.

Referring now to FIG. 4, there is shown a schematic diagram to which illustrates still another alternative embodiment of a method for painting a vehicle according to the present invention. This third method is substantially identical to the second method with the exception that the second step of applying the second method and requiring the application of the first base coat to the vehicle 12 has been replaced with a second step of applying a first base coat 74 to the vehicle 12. That is, in this third method, the first base coat 74 is applied to substantially identical portions 56, 59 of vehicle 12 in the previously delineated manner that forms a portion of the second method. However, the second base coat does not follow immediately after the application has been applied to vehicle 12, of the first base coat 74. Rather, after the first base coat 74, a conventional clear coat 76 is applied to the deposited first base coat 74. The clear coat 76 and the first base coat 74 are conventionally baked in a conventional oven 78. Once the first base coat 74 and the clear coat 76 have been baked, (i.e. the base coat 74 is made to adhere to vehicle 12 and the clear coat 76 is made to adhere to the base coat 74) the clear coat 76 is sanded in a conventional manner as shown in block 80 prior to the application of the second base coat, thereby allowing the vehicle to have an aesthetically pleasing overall appearance.

It should be understood that the invention is not limited to the exact embodiment or construction which has been illustrated and described but that various changes may be made without departing from the spirit and the scope of the invention.

What is claimed is:

1. A method for painting a vehicular body comprising the steps of:

pre-treating said vehicular body;

applying a first base coat to a first part of said vehicular body and to a first portion of a second part of said vehicular body by use of a nozzle of a first type; and applying a second base coat to the entire second part of said vehicular body after said first base coat has been applied by the use of a micro machined matrix array spray nozzle and without masking said first portion, thereby producing a vehicular body having two distinct colors which cooperatively form a distinct line of demarcation.

2. The method of claim 1 wherein said first base coat is incidentally placed upon said second portion.

3. A method in claim 1 wherein said step of applying a second base coat is performed using an assembly which includes a robotic device which guides said micro machined matrix array spray nozzle.

4. A method as in claim 3, wherein said assembly includes a guide member which contacts said vehicle as said second base coat is applied.

5. A method as in claim 1, wherein said second base coat is applied while the first base coat is drying.

6. A method as in claim 1, wherein said step of applying said first base coat and said step of applying said second base coat is performed in a single paint booth.

7. A method for painting a vehicle with a first base coat of a first color on a first portion of said vehicle and a second base coat of a second color on a second portion of said vehicle, said method comprising the steps of:

applying said first base coat to said first portion of said vehicle using a conventional spray nozzle and partially applying said first base coat to said second portion of said vehicle;

applying said second base coat using a micro machined matrix array spray nozzle, said micro machined matrix array spray nozzle alone being effective to form a precise line of demarcation between said first portion of said vehicle and said second portion of said vehicle, said step of applying said second base coat being performed while said first base coat is unmasked.

8. A method as in claim 7 further comprising:

pre-treating said vehicle prior to applying said first base coat.

9. A method as in claim 7 further comprising:

post-treating said vehicle after applying said second base coat.

10. A method as in claim 7, wherein said step of applying a second base coat is performed using an assembly which includes a robotic device which guides said micro machined matrix array spray nozzle.

11. A method as in claim 10, wherein said assembly includes a guide member which contacts said vehicle as said second base coat is applied.

12. A method as in claim 7 further comprising the steps of:

applying a clear coat to the vehicle after applying the first base coat;

baking said first base coat and clear coat in an oven; and sanding said clear coat prior to applying said second base coat.

13. A method for painting a vehicle, said method comprising the steps of:

applying a first base coat to a first portion of said vehicle using a conventional spray nozzle while allowing a portion of said first base coat to be applied to a second portion of said vehicle; and applying a second base coat to a second portion of said vehicle which is immediately adjacent to said first portion, said second base coat being applied at least partially by use of a micro machined matrix array spray nozzle and while said first base coat is unmasked, said micro machined matrix array spray nozzle alone being effective to cause said second base coat to cooperate with said first base coat to form a precise line of demarcation.

* * * * *